US007470505B2

(12) United States Patent
Bertelsen et al.

(10) Patent No.: US 7,470,505 B2
(45) Date of Patent: Dec. 30, 2008

(54) METHODS FOR MAKING MICRO-FLUID EJECTION HEAD STRUCTURES

(75) Inventors: Craig M. Bertelsen, Union, KY (US); Brian C. Hart, Georgetown, KY (US); Melissa M. Waldeck, Lexington, KY (US); Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 423 days.

(21) Appl. No.: 11/234,421

(22) Filed: Sep. 23, 2005

(65) Prior Publication Data

US 2007/0070122 A1 Mar. 29, 2007

(51) Int. Cl.
*B41J 2/16* (2006.01)

(52) U.S. Cl. ..... 430/320; 430/945

(58) Field of Classification Search ..... None
See application file for complete search history.

(56) References Cited

U.S. PATENT DOCUMENTS

| | | | |
|---|---|---|---|
| 4,362,809 A | 12/1982 | Chen et al. | |
| 4,370,405 A | 1/1983 | O'Tolle et al. | |
| 4,557,797 A | 12/1985 | Fuller et al. | |
| 4,609,614 A | 9/1986 | Pampalone et al. | |
| 5,126,289 A | 6/1992 | Ziger | |
| 5,607,824 A | 3/1997 | Fahey et al. | |
| 5,635,333 A | 6/1997 | Petersen et al. | |
| 5,948,290 A * | 9/1999 | Yamamoto et al. | 219/121.71 |
| 6,114,085 A | 9/2000 | Pandamanaban et al. | |
| 6,669,995 B1 | 12/2003 | Insalaco et al. | |
| 2002/0079558 A1 | 6/2002 | Natarajan et al. | |
| 2004/0253535 A1 | 12/2004 | Cameron et al. | |

FOREIGN PATENT DOCUMENTS

| | | |
|---|---|---|
| EP | 0 159 428 | 10/1985 |
| JP | 2005-125619 A * | 5/2005 |

OTHER PUBLICATIONS

"The Reduction in the Standing-Wave Effect in Positive Photoresists," Brewer, et al., *Journal of Applied Photographic Engineering*, 1981, vol. 7, No. 6, pp. 184-186 (abstract only).

"Improvement of Linewidth Control with Antireflective Coating in Optical Lithography," Lin et al., *Journal of Applied Physics*, 1983, vol. 55, No. 4, pp. 1110-1115 (abstract only).

* cited by examiner

*Primary Examiner*—John A. McPherson
(74) *Attorney, Agent, or Firm*—Luedeka, Neely & Graham, PC

(57) ABSTRACT

Methods of making micro-fluid ejection head structures. One of the methods includes providing a substrate having a plurality fluid ejection actuators on a device surface thereof. The device surface of the substrate also has a thick film layer comprising at least one of fluid flow channels and fluid ejection chambers therein. A removable anti-reflective material is applied to at least one or more exposed portions of the device surface of the substrate. A nozzle layer is applied adjacent to the thick film layer. The nozzle layer is imaged to provide a plurality of nozzles in the nozzle layer, and the non-reflective material is removed from the exposed portions of the device surface of the substrate.

20 Claims, 7 Drawing Sheets

METHODS FOR MAKING MICRO-FLUID EJECTION HEAD STRUCTURES

FIELD

The disclosure relates to micro-fluid ejection devices, and in particular to improved methods for making micro-fluid ejection head structures that have precisely formed flow features.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the micro-fluid ejection head itself. This seemingly simple device is a relatively complicated structure containing electrical circuits, ink passageways and a variety of tiny parts assembled with precision to provide a powerful, yet versatile micro-fluid ejection head. The components of the ejection head must cooperate with each other and with a variety of ink formulations to provide the desired print properties. Accordingly, it is important to match the ejection head components to the ink and the duty cycle demanded by the printer. Slight variations in production quality can have a tremendous influence on the product yield and resulting printer performance.

The primary components of an exemplary micro-fluid ejection head are a substrate, a nozzle member (e.g., a nozzle plate) and a flexible circuit attached to the substrate. The substrate can be made of silicon and have various passivation layers, conductive metal layers, resistive layers, insulative layers and protective layers deposited on a device surface thereof. Fluid ejection actuators formed on the device surface may be thermal actuators or piezoelectric actuators, for example. For thermal actuators, individual heater resistors are defined in the resistive layers and each heater resistor corresponds to a nozzle (e.g., a hole) in the nozzle member for heating and ejecting fluid from the ejection head toward a desired substrate or target.

The nozzle members typically contain hundreds of microscopic nozzles for ejecting fluid therefrom. A plurality of nozzle members are usually fabricated in a polymeric film using laser ablation or other micro-machining techniques. Individual nozzle members are excised from the film, aligned, and attached to the substrates on a multi-chip wafer using an adhesive so that the nozzles align with the heater resistors. The process of forming, aligning, and attaching the nozzle members to the substrates is a relatively time consuming process and requires specialized equipment.

Fluid chambers and ink feed channels for directing fluid to each of the ejection actuator devices on the semiconductor chip are typically either formed in the nozzle member material or in a separate thick film layer. In a center feed design for a top-shooter type micro-fluid ejection head, fluid is supplied to the fluid channels and fluid chambers from a slot or ink via which is formed by chemically etching, dry etching, or grit blasting through the thickness of the substrate. The substrate, nozzle member and flexible circuit assembly is typically bonded to a thermoplastic body using a heat curable and/or radiation curable adhesive to provide a micro-fluid ejection head structure.

In order to decrease the cost and increase the production rate of micro-fluid ejection heads, newer manufacturing techniques using less expensive equipment is desirable. These techniques, however, must be able to produce ejection heads suitable for the increased quality and speed demanded by consumers. As the ejection heads become more complex to meet the increased quality and speed demands of consumers, it becomes more difficult to precisely manufacture parts that meet such demand. Accordingly, there continues to be a need for manufacturing processes and techniques which provide improved micro-fluid ejection head components.

The present disclosure includes a method of making a micro-fluid ejection head structure, and micro-fluid ejection head components and structures made by the method. In one embodiment, the method includes providing a substrate having a plurality of fluid ejection actuators on a device surface thereof. The device surface of the substrate also has a thick film layer comprising at least one of fluid flow channels and fluid ejection chambers therein. A removable anti-reflective material is applied to at least one or more exposed portions of the device surface of the substrate. A nozzle layer is applied adjacent to the thick film layer. The nozzle layer is imaged (and in some embodiments developed) to provide a plurality of nozzles in the nozzle layer, and the anti-reflective material is removed from the exposed portions of the device surface of the substrate.

In another embodiment there is provided a method for providing an improved micro-fluid ejection head nozzle member having improved nozzle characteristics. According to the method, a nozzle layer is imaged in the presence of a removable anti-reflective material covering at least exposed portions of a device surface of a substrate to which the nozzle layer is attached. In some embodiments, the imaged nozzle layer is developed to provide a plurality of nozzles therein. The removable anti-reflective layer is removed from the substrate to which the nozzle member is attached.

An advantage of the embodiments described herein can include that they may provide an improved micro-fluid ejection head structures and, in particular, improved nozzle members for micro-fluid ejection heads. Another advantage can include that the methods may enable the formation of nozzles that have a precise size and shape in a nozzle member after the nozzle member has been attached to a micro-fluid ejection head structure. Other advantages of the embodiments described herein may include an ability to readily remove a material that enables such precise nozzles formation in the nozzle member.

BRIEF DESCRIPTION OF THE DRAWINGS

Further features and advantages of the disclosed embodiments will become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
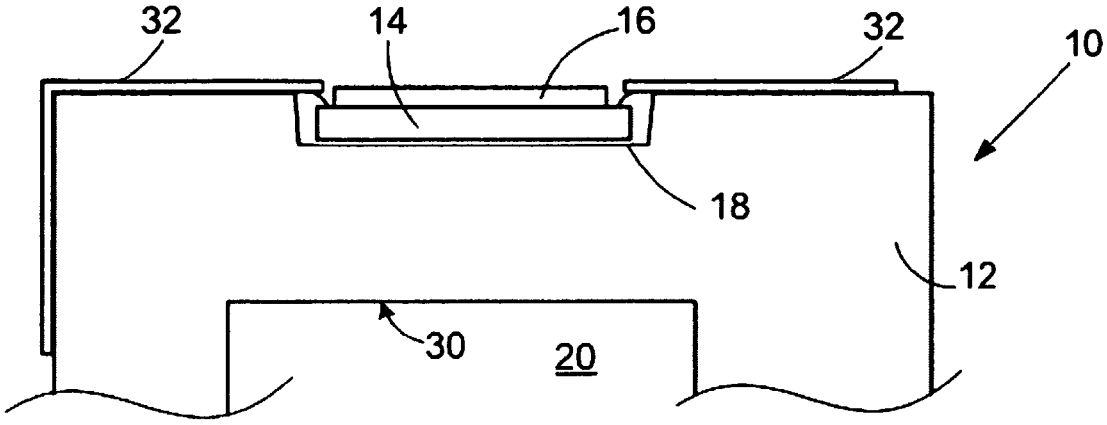
FIG. 1 Prior Art
FIGS. 1 and 2 are cross-sectional views, not to scale, of portions of a prior art micro-fluid ejection head.

With reference to FIG. 1, there is shown a simplified representation of a portion of a prior art micro-fluid ejection head 10, for example an ink jet printhead, viewed from one side and attached to a fluid cartridge body 12. The ejection head 10 includes a substrate 14 and a nozzle member 16. For conventional ink jet printheads, the nozzle member 16 is formed in a film, excised from the film and attached as a separate component to the substrate 14 using an adhesive. The substrate/nozzle member assembly 14/16 is attached in a chip pocket 18 in the cartridge body 12 to form the ejection head 10. Fluid to be ejected, such as an ink, is supplied to the substrate/nozzle member assembly 14/16 from a fluid reservoir 20 in the cartridge body 12 generally opposite the chip pocket 18.

The cartridge body 12 may preferably be made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. A preferred polymeric material for making the cartridge body 12 is NORYL SE1 polymer.

Figure 2:
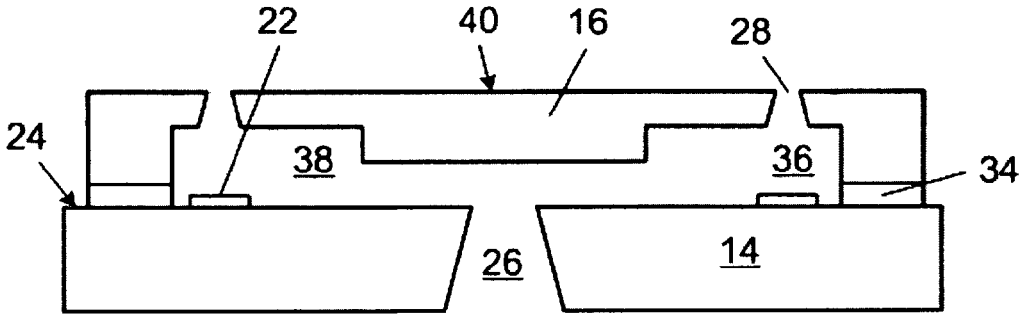
FIG. 2 Prior Art

The substrate 14 can include a silicon semiconductor substrate 14 having a plurality of fluid ejection actuators, such as piezoelectric devices or heater resistors 22, formed on a device side 24 of the substrate 14, as shown in the simplified illustration of FIG. 2. Upon activation of heater resistors 22, fluid supplied through one or more fluid supply slots 26 in the substrate 14 is caused to be ejected through nozzles 28 in nozzle member 16. Fluid ejection actuators, such as heater resistors 22, are formed on the device side 24 of the substrate 14 by well known semiconductor manufacturing techniques.

The substrates 14 are relatively small in size and typically have overall dimensions ranging from about 2 to about 8 millimeters wide by about 10 to about 20 millimeters long and from about 0.4 to about 0.8 mm thick. In conventional substrates 14, the fluid supply slots 26 are grit-blasted in the substrates 14. Such slots 26 typically have dimensions of about 9.7 millimeters long and 0.39 millimeters wide. Fluid may be provided to the fluid ejection actuators by a single one of the slots 26 or by a plurality of openings in the substrate 14 made by a dry etch process selected from reactive ion etching (RIE) or deep reactive ion etching (DRIE), inductively coupled plasma etching, and the like.

The fluid supply slots 26 direct fluid from a reservoir 20, for example, which is located adjacent fluid surface 30 of the cartridge body 12 (FIG. 1) through a passage-way in the cartridge body 12 and through the fluid supply slots 26 in the substrate 14 to the device side 24 of the substrate 14 having heater resistors 22 (FIGS. 1 and 2). The device side 24 of the substrate 14 can also have electrical tracing from the heater resistors 22 to contact pads used for connecting the substrate 14 to a flexible circuit or a tape automated bonding (TAB) circuit 32 (FIG. 1) for supplying electrical impulses from a fluid ejection controller to activate one or more heater resistors 22 on the substrate 14.

Prior to attaching the substrate 14 to the cartridge body 12, the nozzle member 16 is attached to the device side 24 of the substrate, such as by use of one or more adhesives 34. The adhesive 34 used to attach the nozzle member 16 to the substrate 14 can include a heat curable adhesive such as a B-stageable thermal cure resin, including, but not limited to phenolic resins, resorcinol resins, epoxy resins, ethylene-urea resins, furane resins, polyurethane resins and silicone resins. In an exemplary embodiment, a phenolic butyral adhesive, which is cured using heat and pressure, is used as an adhesive 34 for attaching the nozzle member 16 to the substrate 14. The nozzle member adhesive 34 may be cured before attaching the substrate/nozzle member assembly 14/16 to the cartridge body 12.

As shown in detail in FIG. 2, one conventional nozzle member 16 contains a plurality of the nozzles 28, each of which are in fluid flow communication with a fluid chamber 36 and a fluid supply channel 38. The chamber 36 and the channel 38 are formed in the nozzle member material from a side attached to the substrate 14, such as by laser ablation of the nozzle member material. The fluid chamber 36, fluid supply channel 38, and nozzle 28 are referred to collectively as "flow features." After the nozzle member 16 is laser ablated, the nozzle member 16 is washed to remove debris therefrom. Such nozzle members 16 are typically made of polyimide which may contain an ink repellent coating on a surface 40 thereof. Nozzle members 16 may be made from a continuous polyimide film containing the adhesive 34. The film is typically either about 25 or about 50 mm thick and the adhesive is about 12.5 mm thick. The thickness of the film is fixed by the manufacturer thereof. After forming flow features in the film for individual nozzle members 16, the nozzle members 16 are excised from the film.

Figure 3:
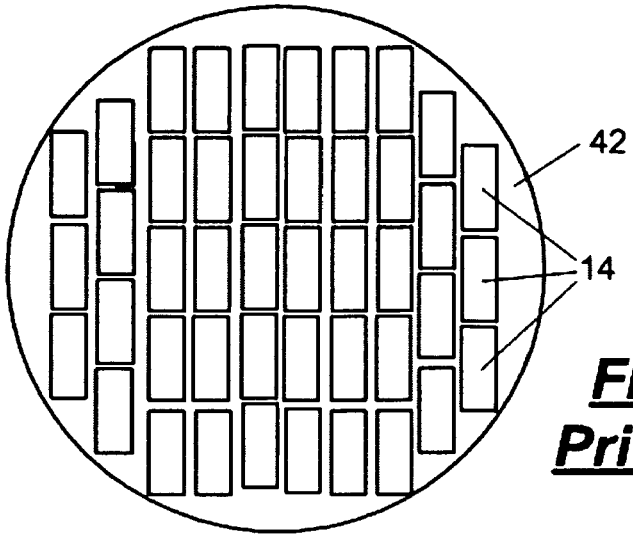
FIG. 3 Prior Art
FIG. 3 is a plan view, not to scale, of a semiconductor wafer comprising a plurality of substrates.

The excised nozzle members 16 are attached to a wafer 42 comprising a plurality of substrates 14 (FIG. 3). An automated device is used to optically align the nozzles 28 in each of the nozzle members 16 with heater resistors 22 on a substrate 14 and attach the nozzle members 16 to the substrates 14. Misalignment between the nozzles 28 and the heater resistors 22 may cause problems such as misdirection of ink droplets from the ejection head 10, inadequate droplet volume or insufficient droplet velocity. The laser ablation equipment and automated nozzle member attachment devices are costly to purchase and maintain. Furthermore it is often difficult to maintain manufacturing tolerances using such equipment in a high speed production process. Slight variations in the manufacture of each unassembled component are magnified significantly when coupled with machine alignment tolerances to decrease the yield of printhead assemblies.

Figure 4A:
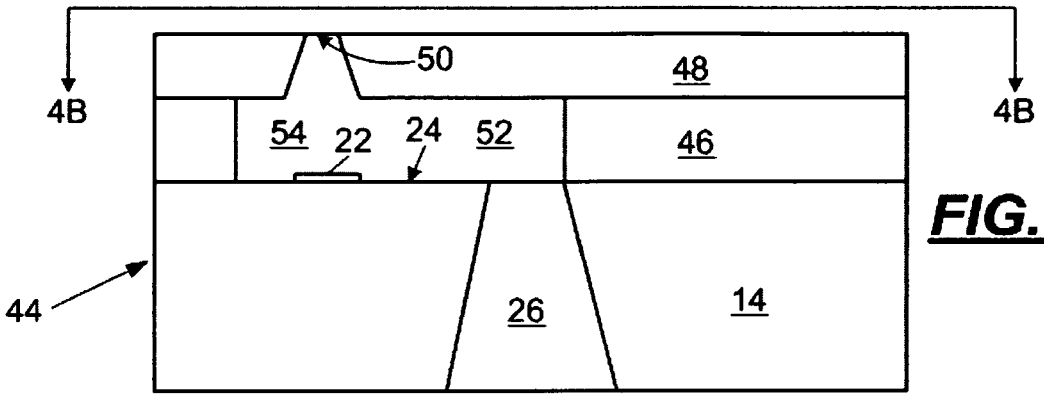
FIG. 4A is a cross-sectional view, not to scale of a portion of a micro-fluid ejection head according to at least one embodiment of the invention.

An improved micro-fluid ejection head structure 44 is illustrated in FIG. 4A. Unlike the prior art structure illustrated in FIG. 2, the improved micro-fluid ejection head includes a thick film layer 46 and a separate nozzle layer 48. A feature of the embodiment of FIG. 4A that can improve the alignment tolerances between nozzles 50 in the nozzle layer and the heater resistors 22 is that the nozzles 50 are formed in the nozzle layer 48 after the nozzle layer 48 is attached to the thick film layer 46. Imaging the nozzles 50 after attaching a nozzle plate material to the thick film layer 46 can enable placement of the nozzles 50 in the optimum location for each of the fluid ejector actuators 22.

Figure 4B:
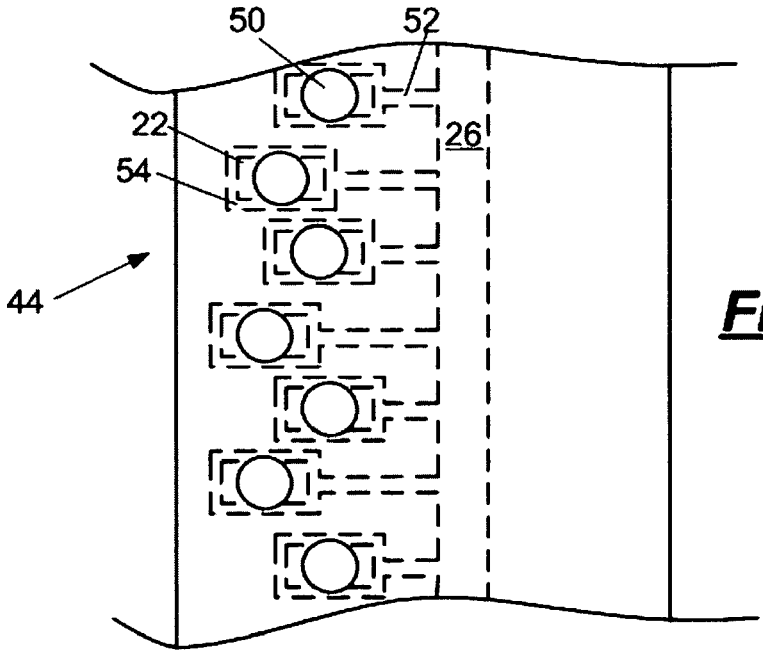
FIG. 4B is a plan view, not to scale, of a portion of a micro-fluid ejection head according to at least one embodiment of the invention.

According to the embodiment illustrated in FIG. 4A, a laser ablatable or photoimageable nozzle layer 48 is attached to the thick film layer 46 that is attached to the device surface 24 of the substrate 14. The thick film layer 46 has been previously imaged to provide fluid flow channels 52 and/or fluid ejection chambers 54 therein. For example, a positive or negative photoresist material may be spin coated, spray coated, laminated or adhesively attached to the device surface 24 of the substrate 14 to provide the thick film layer 46. After imaging the photoresist material and before or after developing the photoresist material, the nozzle layer 48 is attached to the thick film layer. After attaching the nozzle layer 48 to the thick film layer 46, the nozzles 50 are formed in the nozzle layer 48. The nozzles 50 typically have an inlet diameter ranging from about 10 to about 50 microns, and an outlet diameter ranging from about 6 to about 40 microns. A plan view of the micro-fluid ejection head having a plurality of ejection actuators 22, fluid chambers 54, fluid channels 52, and nozzles 50 (i.e., flow features) is illustrated in FIG. 4B. Due to the size of the nozzles, even slight variations or imperfections may have a tremendous impact on the performance of the micro-fluid ejection head 44.

One difficulty faced by manufacturers of the micro-fluid ejection heads 44 described above is that during the formation of the nozzles 50 with laser or ultraviolet imaging techniques, radiation is scattered and/or reflected by the device surface 24 of the substrate 14. Such radiation may be effective to distort the size of the nozzles 50 or form irregular nozzle shapes. Conventional, non-removable, anti-reflective coatings applied to the device surface 24 of the substrate 14 cannot be used since such coatings may cause delamination of the thick film layer 46 from the substrate 14, and may impact fluid flow properties and fluid ejection properties if allowed to remain on the heater resistors 22.

Accordingly, embodiments of the disclosure, described and illustrated in more detail below, provide improved methods for reducing scattering or reflection of radiation by the device surface 24 of the substrate 14 during nozzle formation processes. Scattering and/or reflection of radiation from the device surface 24 of the substrate 14 is substantially reduced by use of a removable anti-reflective material that, in some embodiments, is also pattemable. In one embodiment, an anti-reflective material that is selected to reduce ultraviolet (UV) reflections may be used. Such material may have an index of refraction, when measured at the wavelengths of UV radiation used for imaging the nozzles 50 that is lower than an index of refraction of the nozzle layer 48. In another embodiment, an anti-reflective material may be selected that absorbs UV radiation at the wavelengths used for imaging the nozzles 50 in the nozzle member material 48. In other embodiments, an anti-reflective material that absorbs UV radiation and that has an index of refraction that is lower than the index of refraction of the nozzle layer 48 may be used. Such removable and/or pattemable anti-reflective materials may be selected from positive or negative photoresist materials containing UV absorbent fillers, UV sensitive acrylic materials, UV sensitive polyurethane acrylics, UV sensitive polyimide resins, and water-soluble materials, including but not limited to, polyvinyl acetate, polyacrylamide, and polyethylene oxide.

For example, a positive photoresist material that is sensitive to g-line (436 nanometers) or broadband g,h,i-line (365 to 436 nanometers) UV radiation may be filled with an i-line (365 nanometers) dye or pigment to provide a patternable and removable anti-reflective material that may be applied to the thick film layer 46 and device surface 24 of the substrate 14. Such dye or pigment filled positive photoresist may be patterned using 436 nanometer radiation and developed so that it remains in the fluid chambers 54 and over the heater resistors 22 and/or electrical contacts on the device surface 24 of the substrate 14. During the formation of the nozzles 50 using UV radiation, UV radiation is absorbed by the anti-reflective material so that no significant amount of 365 nanometer radiation is reflected off the device surface 24 of the substrate 14 thereby causing irregular nozzle formation.

Specific examples of patternable and removable anti-reflective materials include polymethyl methacrylate resists containing about 2.6 wt. % coumarin 6 laser dye, a polyimide silane type resin containing a UV absorbing dye, polysulfonyl esters, polybutylsulfone containing a UV absorbing material such as bis-(4-azidophenyl)ether, naphthalene, anthracene, and tetracene. UV absorbing dyes that may be used with positive and negative photoresist materials include, but are not limited to, curcumin and its derivatives, bixin and its derivatives, coumarin derivatives, and halogenate, hydroxylated, and carboxylated dyes and combinations thereof. UV absorbing pigments that may be included in positive and negative photoresist materials include, but are not limited to, blue pigment available from Ciba Specialty Chemicals of Tarrytown, N.Y. under the trade name CIBA IRGALITE blue GLO, and black pigments available from Abbey Group Companies of Philadelphia, Pa. under the trade name ABCOL black 16 BR-126%, and from Tokai Carbon Co., Ltd, of Tokyo, Japan under the trade name AQUA-black 162. The removable and/or patternable anti-reflective material may be applied to the device surface 24 of the substrate 14 with a thickness ranging from about the wavelength of UV radiation (300 nanometers) up to about 30 microns or more.

Figure 5:
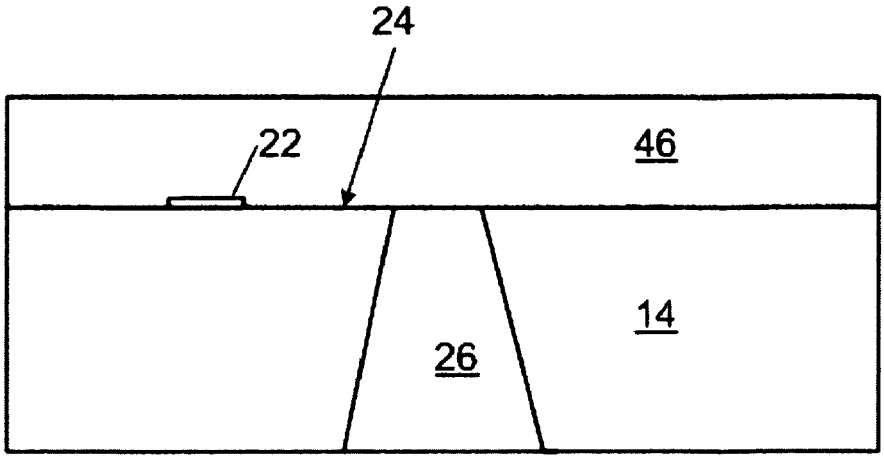
FIGS. 5-7 are schematic views, not to scale, of steps in processes for making micro-fluid ejection heads according to at least one embodiment of the invention.

Methods for making micro-fluid ejection heads 44 according to some exemplary embodiments of the disclosure will now be described with reference to FIGS. 5-17. According to FIG. 5, a positive or negative photoresist material is applied to the device surface 24 of the substrate 14 before or after forming the fluid supply slot 26 in the substrate 14 to provide the thick film layer 46. The thick film layer 46 has a thickness typically ranging from about 10 to about 25 microns. Suitable positive or negative photoresist materials that may be used for layer 46 include, but are not limited to acrylic and epoxy-based photoresists such as the photoresist materials available from Clariant Corporation of Somerville, N.J. under the trade names AZ4620 and AZ1512. Other photoresist materials are available from Shell Chemical Company of Houston, Tex. under the trade name EPON SU8 and photoresist materials available Olin Hunt Specialty Products, Inc. which is a subsidiary of the Olin Corporation of West Paterson, N.J. under the trade name WAYCOAT. An exemplary photoresist material includes from about 10 to about 20 percent by weight difunctional epoxy compound, less than about 4.5 percent by weight multifunctional crosslinking epoxy compound, from about 1 to about 10 percent by weight photoinitiator capable of generating a cation and from about 20 to about 90 percent by weight non-photoreactive solvent as described in U.S. Pat. No. 5,907,333 to Patil et al., the disclosure of which is incorporated by reference herein as if fully set forth herein.

The multi-functional epoxy component of a photoresist formulation used for providing the thick film layer 46 may have a weight average molecular weight of about 3,000 to about 5,000 Daltons as determined by gel permeation chromatography, and an average epoxide group functionality of greater than 3, preferably from about 6 to about 10. The amount of multifunctional epoxy resin in the photoresist formulation for the thick film layer 46 can range from about 30 to about 50 percent by weight based on the weight of the cured thick film layer 46.

A second component of a photoresist formulation for the thick film layer 46 is the di-functional epoxy compound. The di-functional epoxy component may be selected from di-functional epoxy compounds which include diglycidyl ethers of bisphenol-A (e.g. those available under the trade designations "EPON 1007F", "EPON 1007" and "EPON 1009F", available from Shell Chemical Company of Houston, Tex., "DER-331", "DER-332", and "DER-334", available from Dow Chemical Company of Midland, Mich., 3,4-epoxycyclohexylmethyl-3,4-epoxycyclo-hexene carboxylate (e.g. "ERL-4221" available from Union Carbide Corporation of Danbury, Connecticut, 3,4-epoxy-6-methylcyclohexylmethyl-3,4-epoxy-6-methylcyclohexene carboxylate (e.g. "ERL-4201 " available from Union Carbide Corporation), bis(3,4-epoxy-6-methylcyclohexylmethyl) adipate (e.g. "ERL-4289" available from Union Carbide Corporation), and bis(2,3-epoxycyclopentyl) ether (e.g. "ERL-0400" available from Union Carbide Corporation.

An exemplary first di-functional epoxy component is a bisphenol-A/epichlorohydrin epoxy resin available from Shell Chemical Company of Houston, Tex. under the trade nane EPON resin 1007F having an epoxide equivalent of greater than about 1000. An "epoxide equivalent" is the number of grams of resin containing 1 gram-equivalent of epoxide. The weight average molecular weight of the di-functional epoxy component is typically above 2500 Daltons, e.g., from about 2800 to about 3500 weight average molecular weight. The amount of the di-functional epoxy component in the thick film photoresist formulation may range from about 30 to about 50 percent by weight based on the weight of the cured resin.

The photoresist formulation for the thick film layer 46 may also include a photoacid generator devoid of aryl sulfonium salts. The photoacid generator can be a compound or mixture of compounds capable of generating a cation such as an aromatic complex salt which may be selected from onium salts of a Group VA element, onium salts of a Group VIA element, and aromatic halonium salts. Aromatic complex salts, upon being exposed to ultraviolet radiation or electron beam irradiation, are capable of generating acid moieties which initiate reactions with epoxides. The photoacid generator may be present in the photoresist formulation for the thick film layer 46 in an amount ranging from about 5 to about 15 weight percent based on the weight of the cured resin.

Of the aromatic complex salts which are suitable for use in an exemplary photoresist formulation disclosed herein, suitable salts are di- and triaryl-substituted iodonium salts. Examples of aryl-substituted iodonium complex salt photoacid generaters include, but are not limited to: diphenyliodonium trifluoromethanesulfonate, (p-tert-butoxyphenyl)phenyliodonium trifluoromethanesulfonate, diphenyliodonium p-toluenesulfonate, (p-tert-butoxyphenyl)-phenyliodonium p-toluenesulfonate, bis(4-tert-butylphenyl)iodonium hexafluorophosphate, and diphenyliodonium hexafluoroantimonate.

An exemplary iodonium salt for use as a photoacid generator for the embodiments described herein is a mixture of diaryliodonium hexafluoroantimonate salts, commercially available from Sartomer Company, Inc. of Exton, Pa. under the trade name SARCAT CD 1012

A photoresist formulation for the thick film layer 46 may optionally include an effective amount of an adhesion enhancing. agent such as a silane compound. Silane compounds that are compatible with the components of the photoresist formulation typically have a functional group capable of reacting with at least one member selected from the group consisting of the multifunctional epoxy compound, the difunctional epoxy compound and the photoinitiator. Such an adhesion enhancing agent may be a silane with an epoxide functional group such as a glycidoxyalkyltrialkoxysilane, e.g., gamma-glycidoxypropyltrimethoxysilane. When used, the adhesion enhancing agent can be present in an amount ranging from about 0.5 to about 2 weight percent, such as from about 1.0 to about 1.5 weight percent based on total weight of the cured resin, including all ranges subsumed therein. Adhesion enhancing agents, as used herein, are defined to mean organic materials soluble in the photoresist composition which assist the film forming and adhesion characteristics of the thick film layer 46 on the device surface 24 of the substrate 14.

The thick film layer 46 may be applied to the device surface 24 of the substrate by a variety of conventional semiconductor processing techniques, including but not limited to, spin-coating, roll-coating, spraying, dry lamination, adhesives and the like. An exemplary method includes spin coating the resin formulation onto the device surface 24 of the substrate 14 by use of a solvent. A suitable solvent includes a solvent which is non-photoreactive. Non-photoreactive solvents include, but are not limited gamma-butyrolactone, $C_{1-6}$ acetates, tetrahydrofuran, low molecular weight ketones, mixtures thereof and the like. An exemplary non-photoreactive solvent is acetophenone. The non-photoreactive solvent is present in the formulation mixture used to provide the thick film layer 46 in an amount ranging of from about 20 to about 90 weight percent, such as from about 40 to about 60 weight percent, based on the total weight of the photoresist formulation. In an exemplary embodiment of the present invention, the non-photoreactive solvent does not remain in the cured thick film layer 46 and is thus removed prior to or during the thick film layer 46 curing steps.

Figure 6:
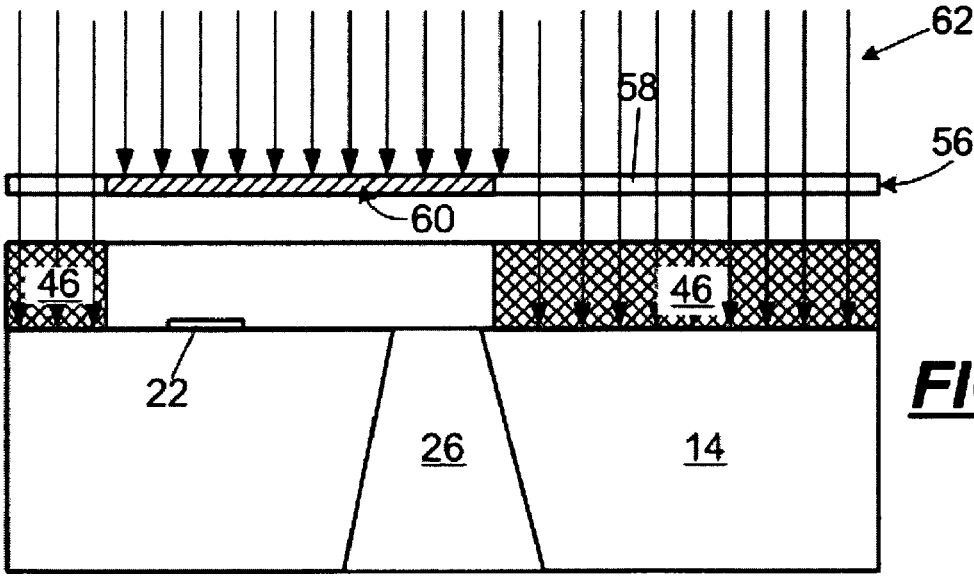
Figure 7:
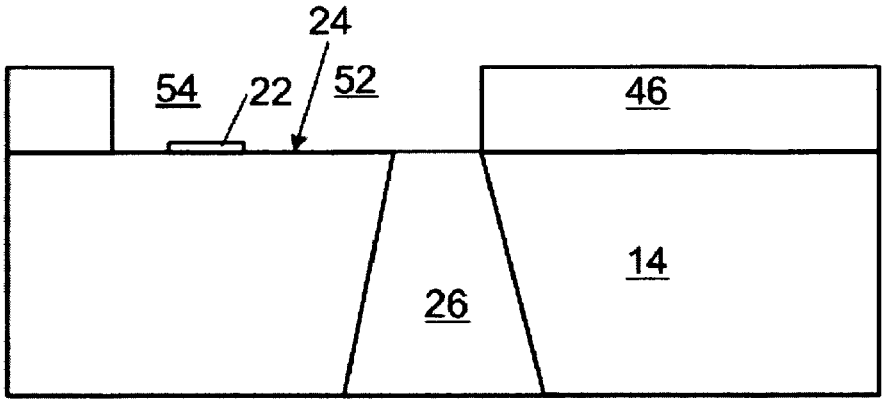

A method for imaging the thick film layer 46 will now be described with reference to FIGS. 6-7. In order to define the fluid chambers 54 and fluid flow channels 52 in the thick film layer 46, the layer 46 is masked with a mask 56 comprising substantially transparent areas 58 and substantially opaque areas 60 thereon. Areas of the thick film layer 46 masked by the opaque areas 60 of the mask 56 will be removed upon developing to provide the fluid chambers 54 and flow channels 52 described above.

A radiation source provides actinic radiation indicated by arrows 62 to image the thick film layer 46. A suitable source of radiation emits actinic radiation at a wavelength within the ultraviolet and visible spectral regions. Exposure of the thick film layer 46 may be from less than about 1 second to 10 minutes or more, such as about 5 seconds to about one minute, depending upon the amounts of particular epoxy materials and aromatic complex salts being used in the formulation and depending upon the radiation source, distance from the radiation source, and the thickness of the thick film layer 46. The thick film layer 46 may optionally be exposed to electron beam irradiation instead of ultraviolet radiation.

The foregoing procedure is similar to a standard semiconductor lithographic process. The mask 56 is a clear, flat substrate (e.g., usually glass or quartz) with opaque areas 60 defining areas of the thick film layer 46 that are to be removed after development. The opaque areas 60 prevent the ultraviolet light from contacting the thick film layer 46 masked beneath it so that such areas remain soluble in a developer. The exposed areas of the layer 46 provided by the substantially transparent areas 58 of the mask 56 are reacted and therefore rendered insoluble in the developer. The solubilized material is removed leaving the imaged and developed thick film layer 46 on the device surface 24 of the substrate 14 as shown in FIG. 7. The developer comes in contact with the substrate 14 and thick film layer 46 through either immersion and agitation in a tank-like setup or by spraying the developer on the substrate 14 and thick film layer 46. Either spray or immersion should adequately remove the imaged material. Illustrative developers include, for example, butyl cellosolve acetate, a xylene and butyl cellosolve acetate mixture, and $C_{1-6}$ acetates like butyl acetate.

Figure 8:
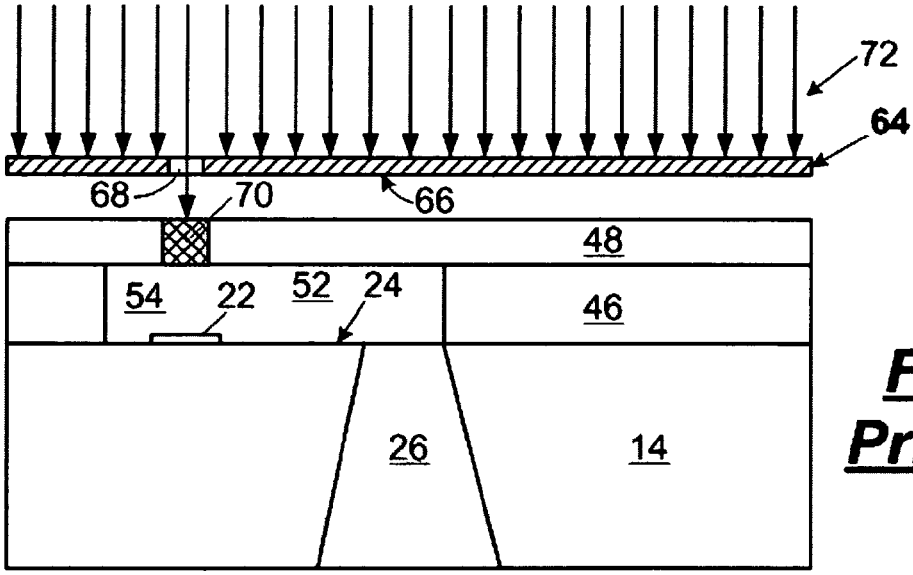
FIG. 8 Prior Art
FIG. 8 is a schematic view, not to scale, of a prior art process form making a micro-fluid ejection head.

In a prior art process illustrated in FIG. 8, the nozzle layer 48 is applied to the thick film layer 46. A second mask 64 comprising opaque areas 66 and transparent area 68 is used to define the nozzle location 70 in the nozzle layer 48 using a radiation source indicated by arrows 72. However, as described above, reflected radiation from the device surface 24 of the substrate 14 may affect the imaging of the nozzle layer 48.

Figure 9:
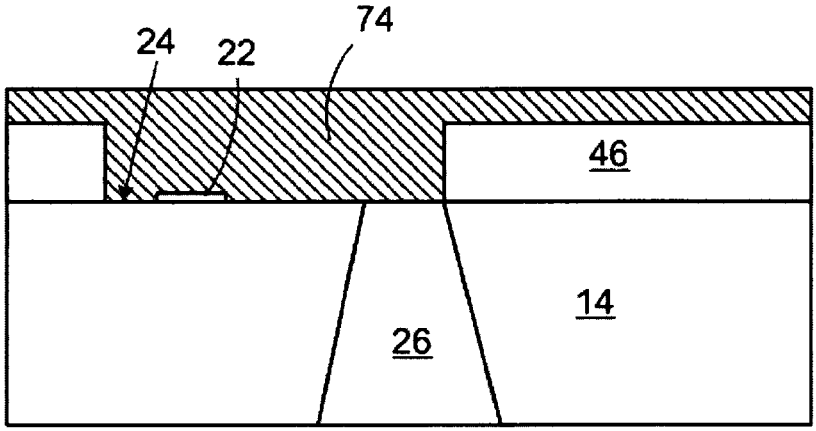
FIGS. 9-18 are schematic views, not to scale, of steps in alternative processes for making micro-fluid ejection heads according to at least one embodiment of the invention.
Figure 10:
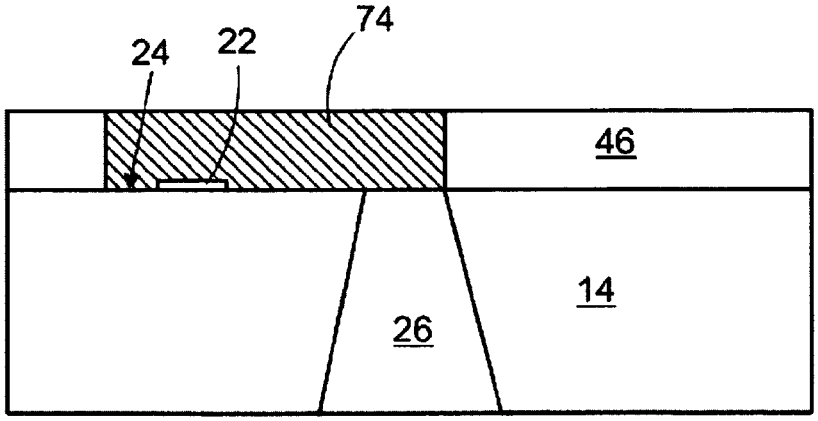

In order to reduce reflected radiation during the nozzle imaging step, a removable anti-reflective material, such as a patternable and removable anti-reflective material is applied to the device surface 24 of the substrate 14 and/or to the thick film layer 46 as shown in FIG. 9 to provide an anti-reflective layer 74. The layer 74 may be applied to the thick film layer 46 and substrate 14 by spin-coating, spray-coating, screen printing, needle deposition, and the like. The thickness of the anti-reflective layer may range from the wavelength of UV radiation (300 nanometers) to about 30 microns or more. If the anti-reflective layer 74 is applied so that it covers the thick film layer 46 and the device surface 24 of the substrate, the layer 74 is then patterned as shown in FIG. 10 so that it only covers areas of the substrate surface 24 that may reflect radiation during an imaging step for the nozzle layer 48. Patterning of the anti-reflective layer 74 may be conducted by as dry etching, chemical-mechanical polishing, wet etching, and the like, or in the case of a photoresist material providing the anti-reflective layer 74, the layer 74 may be patterned by imaging and developing the imaged layer using a mask as described above.

Areas of the substrate surface 24 that might be covered by the anti-reflective layer 74 include the heater resistor 22, the fluid chamber 54, the fluid flow channel 52, and electrical contact pad areas (not shown). If the fluid supply slot 26 has not already been formed in the substrate 14, then before the anti-reflective material 74 is removed, the fluid supply slot 26 may be wet or dry etched or grit blasted through the substrate 14. In an alternative process, the anti-reflective layer 74 is also used as an etch resistant mask for dry etching the slot 26 through the substrate 14 using a deep reactive ion etching process.

Figure 11:
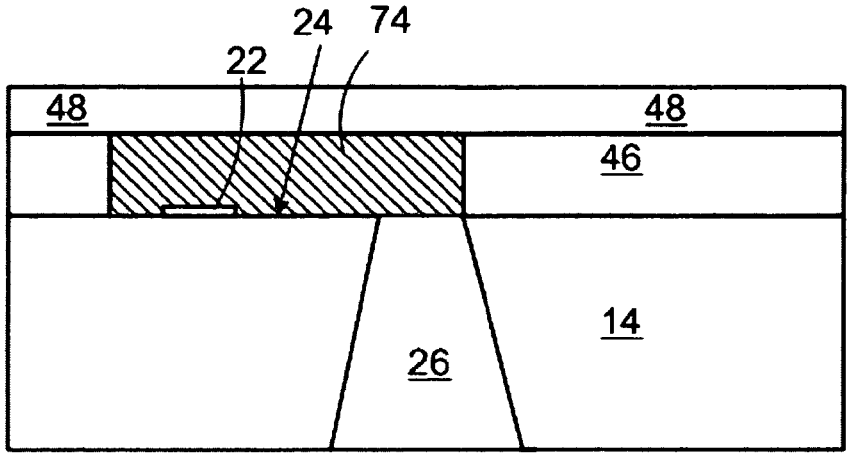
Figure 12:
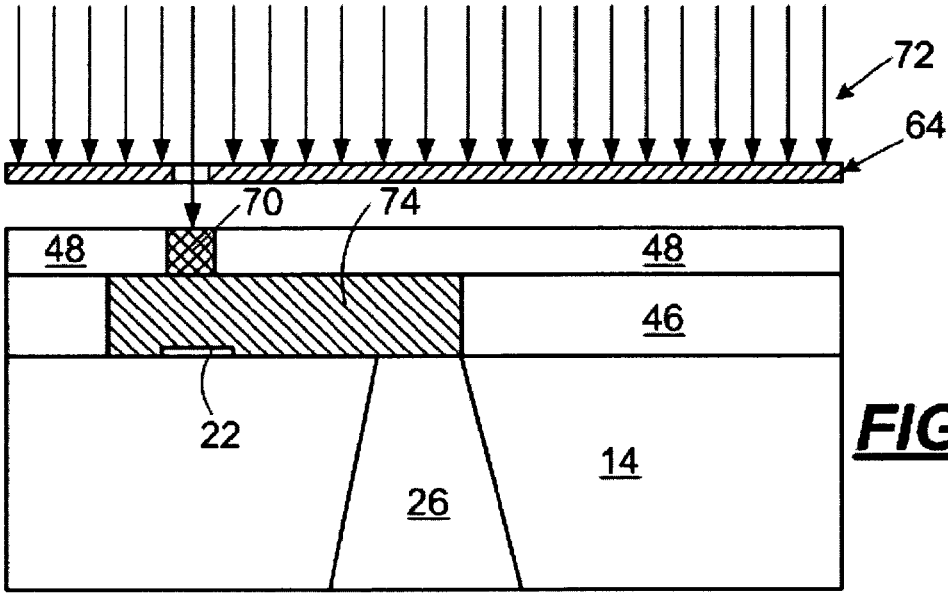
Figure 13:
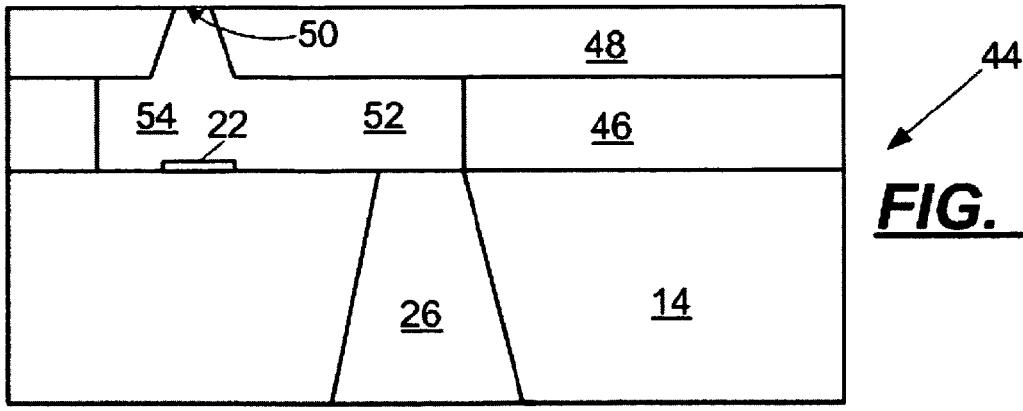

Before the anti-reflective layer 74 is removed from the substrate 14, the nozzle layer 48 can be applied to the thick film layer 46 as shown in FIG. 11. The nozzle layer 48 may be applied to the thick film layer 46 as by an adhesive, thermal compression bonding, or other laminating technique. Since the anti-reflective layer 74 has not been removed from the substrate 14, the nozzle layer 48 may also be spin-coated onto the thick film layer 46 and anti-reflective layer 74. As described above with reference to FIG. 8, the nozzle layer 48 may be imaged through the mask 64 using UV radiation to provide the imaged areas 70. Upon developing the nozzle layer 48, the imaged areas 70 becomes the nozzles 50 (FIG. 13). The anti-reflective layer 74 may be removed by the developing liquid for the nozzle layer 48, or may be removed at a later point in an assembly process for the micro-fluid ejection head.

Figure 14:
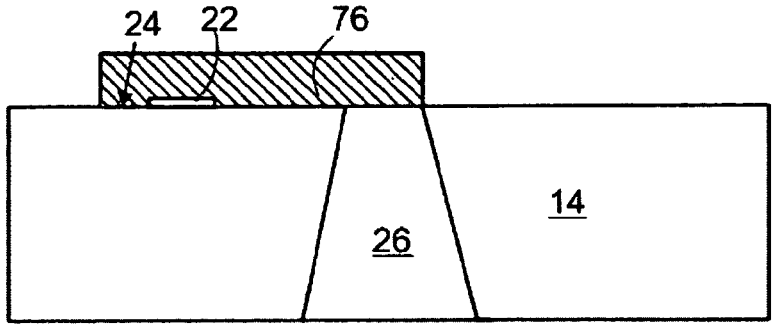
Figure 15:
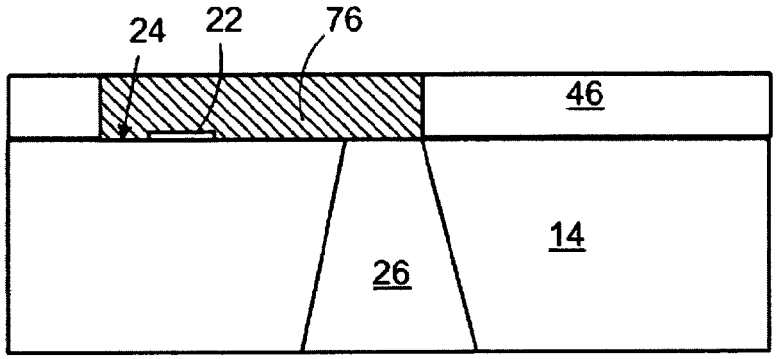

Instead of applying the anti-reflective material to the substrate 14 after the thick film layer 46 has been applied to the substrate 14, the anti-reflective material may be applied to the device surface 24 of the substrate 14 before the thick film layer 46 is applied to the substrate 14. In that case, the anti-reflective material may be patterned to provide an anti-reflective layer 76 as shown in FIG. 14. The thick film layer 46 may then be applied to the device surface 24 of the substrate 14 as shown in FIG. 15, whereupon the thick film layer 46 is imaged and developed as described with reference to FIG. 6. The steps described with reference to FIGS. 11-13 may then be used to complete the formation of the micro-fluid ejection head 44.

In the foregoing embodiments, the anti-reflective layer 74 or 76 may be applied to the substrate 14 before or after the fluid supply slot 26 is formed in the substrate 14. Alternate embodiments of the disclosure are illustrated in FIGS. 16-18 wherein the anti-reflective material is applied to the substrate 14 only after forming the fluid supply slot 26 in the substrate.

Figure 16:
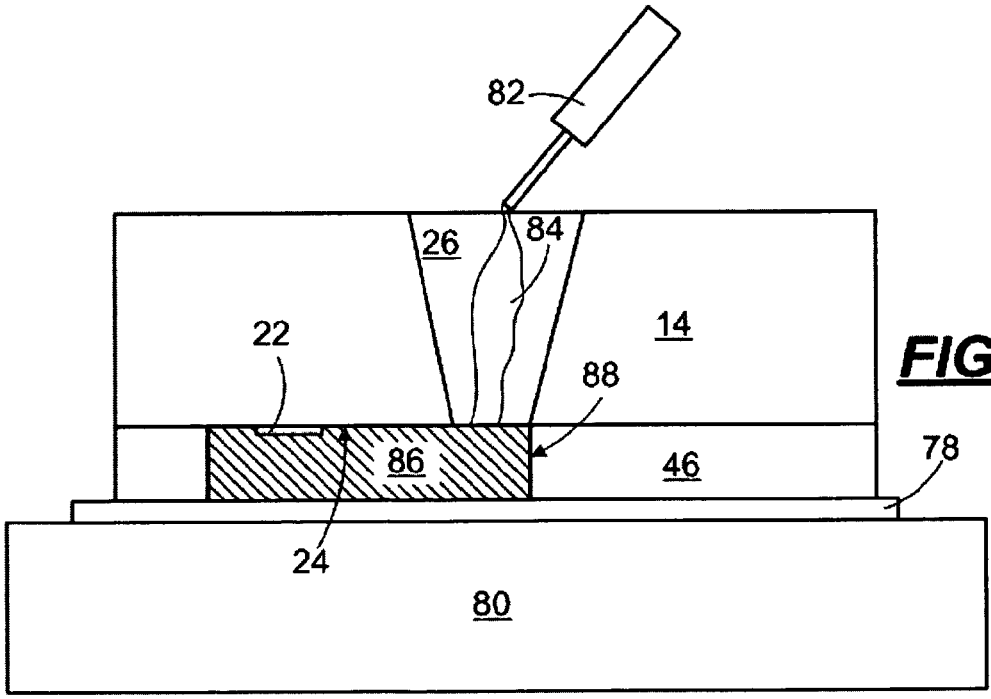

In one embodiment, illustrated in FIG. 16, a substrate 14 having an imaged and developed thick film layer 46 is placed device surface down on a release liner 78 on a solid support 80. A needle dispense unit 82 is used to dispense the anti-reflective material 84 through the fluid supply slot 26 so that it forms an anti-reflective layer 86 that fills the patterned and developed areas 88 in the thick film layer 46. The anti-reflective material 84 may also partially or completely fill the fluid supply slot 26 in the substrate 14. The release liner 78 provides a fluid seal between the release liner 78 and thick film layer 46 and prevents the thick film layer 46 and anti-reflective layer 86 from sticking to the support 80. The anti-reflective layer 86 thus formed is dried, cured, or otherwise solidified before proceeding with the steps for completing the micro-fluid ejection head as described with reference to FIGS. 11-13 above.

Figure 17:
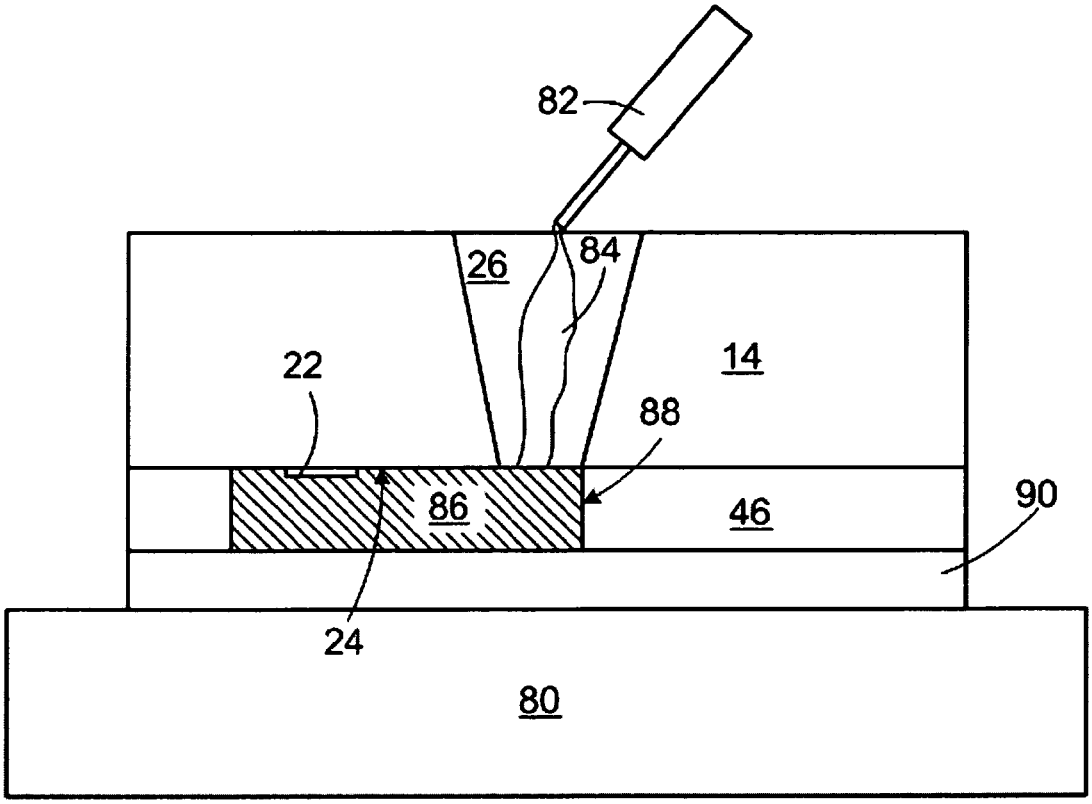
Figure 18:
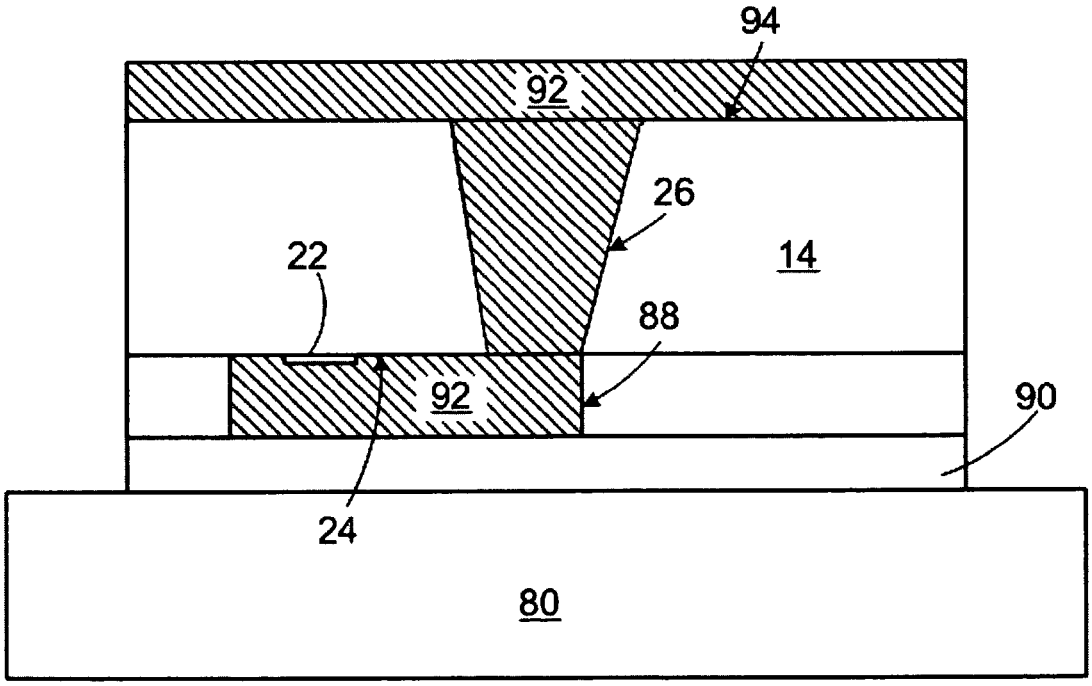

Variations on the embodiment described with reference to FIG. 16, are illustrated in FIGS. 17 and 18. In a first variation, a nozzle layer 90 is applied to the thick film layer 46 before the anti-reflective material 84 is dispensed through the fluid supply slot 26 to fill the patterned and developed areas 88 in the thick film layer 46. The thick film layer 46 and nozzle layer 90 are placed face down on the support 80, then the anti-reflective material 84 is dispensed through the fluid supply slot 26 as described above with reference to FIG. 16 to fill the patterned and developed areas 88 between the thick film layer 46 and the nozzle layer 90. In this case, the nozzle layer 90 may protect the anti-reflective layer 86 and thick film layer 46 from contamination. In this embodiment, the nozzle layer 90 may be laminated to the thick film layer 46, adhesively attached to the thick film layer 46, or the nozzle layer 90 may be provided by a spin-coated material on a release liner to which the thick film layer is attached. Further processing of the micro-fluid ejection head 44 then proceeds as described above with reference to FIGS. 12-13.

A further variation of the foregoing embodiments is illustrated in FIG. 18. According to this variation, an anti-reflective material 92 is applied to a fluid supply side 94 of the substrate 14 in a manner so that it flows through the fluid supply slot 26 and fills the patterned and developed areas 88 in the thick film layer 46. In this case, either the release liner process described with reference to FIG. 16 or the nozzle member process described with reference to FIG. 17 may be used to seal between the thick film layer 46 and the support 80. The anti-reflective material 92 may remain on the fluid supply side 94 of the substrate 14 if there is no adverse effects from not removing the anti-reflective material 92 from the fluid supply side 94, or the anti-reflective material 92 may be selectively or completely removed from the fluid supply side 94 by a solvent or by a chemical-mechanical polishing technique.

In all of the foregoing embodiments, it will be appreciated that the anti-reflective material may be applied on a wafer level to the individual substrates 14 on the wafer 42. Accordingly, if the anti-reflective material is a water soluble material, the anti-reflective material may be removed during a washing step used to rinse the micro-fluid ejection heads 44 after dicing the wafer 42 into the individual micro-fluid ejection heads 44.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A method of making a micro-fluid ejection head structure comprising a substrate having a plurality of fluid ejection actuators on a device surface thereof and having a thick film layer comprising at least one of fluid flow channels and fluid ejection chambers therein, the method comprising:

applying a removable anti-reflective material to at least one or more exposed portions of the device surface of the substrate;

applying a nozzle layer adjacent to the thick film layer;

imaging a plurality of nozzles in the nozzle layer; and removing the anti-reflective material from the exposed portions of the device surface of the substrate to which the anti-reflective material has been applied.

2. The method of claim 1, wherein the removable anti-reflective material is selected from the group consisting of materials having a lower index of refraction than an index of refraction of the nozzle layer at a wavelength used to image the nozzle layer; materials that absorb ultraviolet radiation at a wavelength used to image the nozzle layer, and materials that have a lower index of refraction and that absorb ultraviolet radiation at a wavelength used to image the nozzle layer.

3. The method of claim 2, wherein the anti-reflective material is selected from the group consisting of a photoresist material containing an ultraviolet absorbent filler, an ultraviolet absorbent polyimide, an ultraviolet absorbent acrylic, a water soluble polyacrylamide, a water soluble poly vinyl acetate, and a water soluble polyethylene oxide.

4. The method of claim 1, wherein the anti-reflective material is selected from the group consisting of a photoresist material containing an ultraviolet absorbent filler, an ultraviolet absorbent polyimide, an ultraviolet absorbent acrylic, a water soluble polyacrylamide, a water soluble poly vinyl acetate, and a water soluble polyethylene oxide.

5. The method of claim 1, wherein the anti-reflective material is selected from the group of positive photoresist materials containing a pigment filler, negative photoresist materials containing a pigment filler, positive photoresist materials containing a dye filler, and negative photoresist materials containing a dye filler, wherein the fillers are sufficient to absorb ultraviolet radiation.

6. The method of claim 1, wherein the anti-reflective material is applied to the exposed portions of the device surface of the substrate through a fluid supply slot in the substrate.

7. The method of claim 1, wherein the anti-reflective material is applied to the exposed portions of the device surface of the substrate by a process selected from the group consisting of spin-coating, spray coating, and screen printing.

8. The method of claim 1, wherein the anti-reflective material is applied to the exposed portions of the device surface of the substrate with a thickness ranging from about 300 nanometers to about a thickness of the thick film layer.

9. The method of claim 1, wherein the act of imaging a plurality of nozzles in the nozzle layer further comprises developing the nozzles.

10. The method of claim 1, wherein the act of imaging a plurality of nozzles comprises laser ablating a plurality of nozzles in the nozzle layer.

11. A method for providing an improved micro-fluid ejection head nozzle member having improved nozzle characteristics, the method comprising:

imaging a nozzle layer in the presence of a removable anti-reflective material covering at least exposed portions of a device surface of a substrate to which the nozzle layer is attached, the head nozzle member also having a thick film layer disposed between the substrate and the nozzle layer and comprising at least one of fluid flow channels and fluid ejection chambers therein; and removing the removable anti-reflective layer from the substrate to which the nozzle member is attached.

12. The method of claim 11, wherein the exposed portions of the device surface of the substrate comprise fluid ejector actuators and electrical contacts.

13. The method of claim 11, wherein the removable anti-reflective material is selected from the group consisting of materials having a lower index of refraction than an index of refraction of the nozzle layer at a wavelength used to image the nozzle layer; materials that absorb ultraviolet radiation at a wavelength used to image the nozzle layer, and materials that have a lower index of refraction and that absorb ultraviolet radiation at a wavelength used to image the nozzle layer.

14. The method of claim 13, wherein the anti-reflective material is selected from the group consisting of a photoresist material containing an ultraviolet absorbent filler, an ultraviolet absorbent polyimide, an ultraviolet absorbent acrylic, a water soluble polyacrylamide, a water soluble poly vinyl acetate, and a water soluble polyethylene oxide.

15. The method of claim 11, wherein the antireflective material is selected from the group consisting of a photoresist material containing an ultraviolet absorbent filler, an ultraviolet absorbent polyimide, an ultraviolet absorbent acrylic, a water soluble polyacrylamide, a water soluble poly vinyl acetate, and a water soluble polyethylene oxide.

16. The method of claim 11, wherein the anti-reflective material is applied to the substrate to cover the exposed portions of the device surface of the substrate through a fluid supply slot in the substrate.

17. The method of claim 11, wherein the anti-reflective material is applied to the substrate to cover exposed portions of the device surface of the substrate by a process selected from the group consisting of spin-coating, spray coating, and screen printing.

18. The method of claim 11, wherein the anti-reflective material has a thickness ranging from about 300 nanometers to about 30 microns.

19. The method of claim 11, further comprising developing the imaged nozzle layer to provide a plurality of nozzles therein.

20. The method of claim 11, wherein the act of imaging a nozzle layer comprises laser ablating the nozzle layer to provide a plurality of nozzles therein.

* * * * *